US006601364B2

(12) United States Patent
Sussmeier

(10) Patent No.: US 6,601,364 B2
(45) **Date of Patent: *Aug. 5, 2003**

(54) METHOD AND DEVICE FOR SYNCHRONIZING MOTION FOR INSERT FEEDERS IN AN INSERTION SYSTEM

(75) Inventor: John W. Sussmeier, Cold Spring, NY (US)

(73) Assignee: Pitney Bowes Inc., Stamford, CT (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/385,515

(22) Filed: Aug. 30, 1999

(65) Prior Publication Data

US 2003/0097821 A1 May 29, 2003

(51) Int. Cl.[7] ..... B65B 57/00
(52) U.S. Cl. ..... 53/52; 53/460
(58) Field of Search ..... 53/460, 53, 52, 53/542

(56) References Cited

U.S. PATENT DOCUMENTS

| | | | | |
|---|---|---|---|---|
| 4,739,606 A | | 4/1988 | Cantile | 53/493 |
| 4,924,652 A | * | 5/1990 | Krasuski | 53/55 |
| 5,031,891 A | * | 7/1991 | Kobler et al. | 270/52.03 |
| 5,647,583 A | * | 7/1997 | Emigh et al. | 270/52.04 |
| 5,675,650 A | * | 10/1997 | Cordery et al. | 380/23 |
| 5,730,436 A | * | 3/1998 | Viebach et al. | 270/52.16 |
| 5,823,521 A | * | 10/1998 | Emigh et al. | 270/58.06 |
| 6,328,297 B1 | * | 12/2001 | Antonelli et al. | 270/52.16 |

FOREIGN PATENT DOCUMENTS

| | | |
|---|---|---|
| DE | 3500416 | 1/1985 |
| EP | 0228182 | 11/1986 |
| EP | 0335091 | 2/1989 |
| EP | 0738879 | 4/1996 |

OTHER PUBLICATIONS

Communication Search Report–dated Dec. 4, 2002.

* cited by examiner

*Primary Examiner*—Stephen F. Gerrity
*Assistant Examiner*—John Paradiso
(74) *Attorney, Agent, or Firm*—Michael J. Cummings; Charles R. Malandra, Jr.; Angelo N. Chaslas

(57) ABSTRACT

A method and device for synchronizing the motion between a chassis (master) motor and one or more enclosure feeder (slave) motors in an envelope inserting machine. The motion profile of one motor can be varied with time independently of the others. The displacement mapping method uses encoders, such as optical encoders, to obtain the displacement of each of the associated motors as a function of time. From the actual displacement of the master motor, an electronic computation device or process is used to calculate the theoretical displacement of each slave motor according the motion profile of the slave motor. The theoretical displacement is then compared to the actual displacement. If there is a discrepancy between the theoretical and the actual amount, then the motion of the slave motor will be adjusted so as to eliminate that displacement discrepancy.

16 Claims, 5 Drawing Sheets

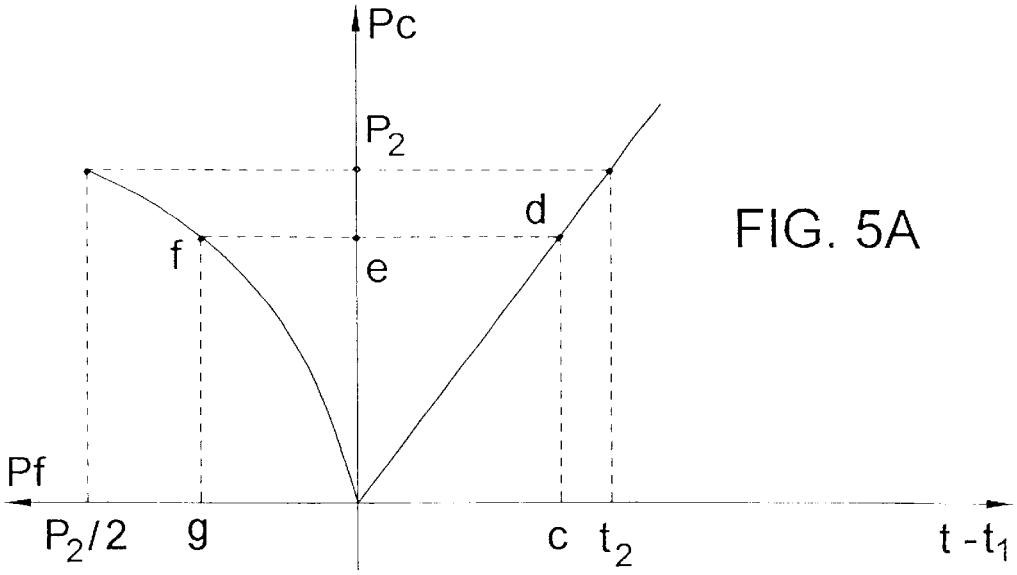
FIG. 5A
FIG. 5B
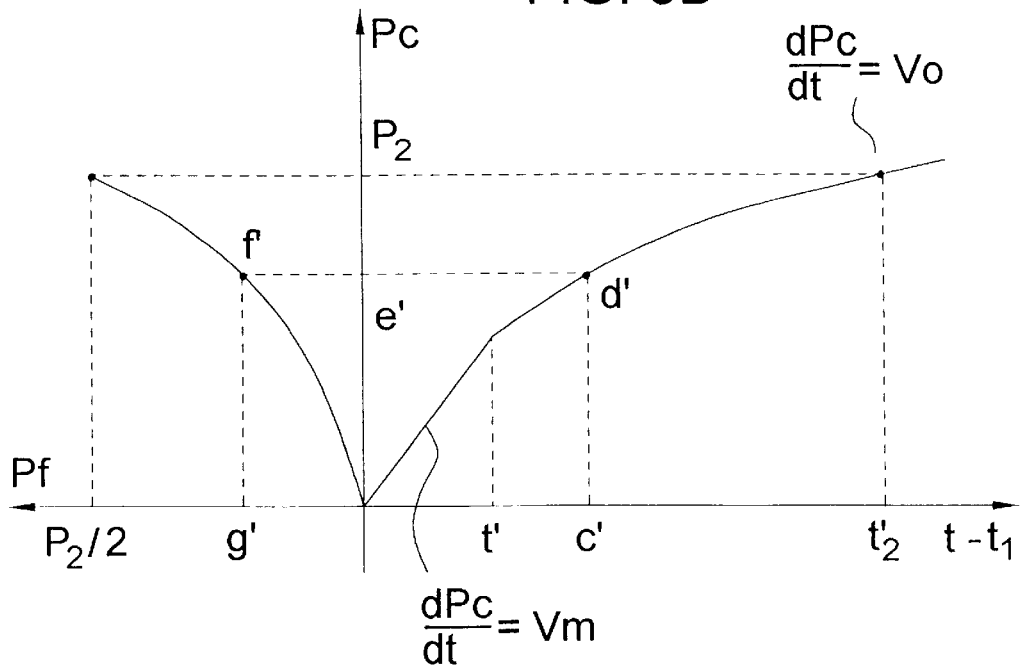

METHOD AND DEVICE FOR SYNCHRONIZING MOTION FOR INSERT FEEDERS IN AN INSERTION SYSTEM

TECHNICAL FIELD

The present invention generally relates to a method to control motion in a machine having a number of inter-related movement devices and, more specifically, to the synchronization of the motion between the gathering transport and the enclosure feeders in a mail inserter system.

BACKGROUND OF THE INVENTION

In a mail inserting machine for mass mailing, there is a gathering section where enclosure material is gathered before it is inserted into an envelope. This gathering section is sometimes referred to as a chassis subsystem, which includes a gathering transport with pusher fingers rigidly attached to a conveying belt and a plurality of enclosure feeders mounted above the gathering transport. If the enclosure material contains many documents, these documents must be individually and separately fed from different enclosure feeders. Each of the enclosure feeders feeds or releases a document at an appropriate time such that the trailing edge of the document released from the enclosure feeder is just slightly forward of a moving pusher finger. Timing and velocity control of all feeders are critical because during the feeding process a document is under the control of both an enclosure feeder motor and the gathering transport motor.

Currently, one or more long endless chains driven by a single motor are used to move the pusher fingers in order to gather the enclosure material released from the enclosure feeders and then send the gathered material to an insertion station. It is preferable that the spacing of the pusher fingers attached to the conveying chain is substantially the same as the spacing of the enclosure feeders mounted above the conveying chain. A typical pitch of the enclosure feeder is 13.5" (343 mm). Depending on the length of the document stacked on a feeder, the feeder is given a Ago=signal to release a sheet of a document onto the conveying belt at an appropriate time. Typically, the feeder motor is set in motion only for releasing a document to an approaching pusher finger. After the document is released, the feeder motor is stopped to wait for the arrival of the next pusher finger. The conveyor belt, however, must be continuously driven in order to gather documents released by different enclosure feeders. Thus, the motion profile of the chassis is different from that of the enclosure feeders. Moreover, when the enclosure material contains documents of different lengths, the start and stop timing for one feeder motor may be different from another. The existence of different motion profiles of the feeder motors will make synchronization between the chassis motor and all feeder motors difficult. However, probably the most difficult motion to synchronize is when a chassis is required to stop and restart at any time in a machine cycle.

In the past, electronic gearing has been used to synchronize the motion between a number of motors. Electronic gearing uses electronic means to maintain the motion profiles between two or more motors, instead of using mechanical gears, or belts and pulleys. For example, pulse generators of different pulse rates can be used to drive different motors. If the pulse rates are maintained at a fixed ratio, then the motion profiles of motors would be similar. This is equivalent to using mechanical gears at a fixed gear ratio to drive different shafts by the same motor. In order to maintain the synchronism between motors in electronic gearing, encoders attached to motors can be used to monitor the ratio of the displacement between motors. If the speed ratio of two motors is a constant, then it is expected that the ratio of the encoder readings from the respective motors is also a constant. However, if the speed ratio between two motors is not constant, the above-described method of electronic gearing will become impractical, if not totally infeasible.

It is advantageous to provide a method for monitoring and controlling motion between different moving devices wherein the speed ratio can be varied with time.

SUMMARY OF THE INVENTION

The present invention provides a displacement mapping method and apparatus to synchronize the motion between a master motor and one or more slave motors wherein the motion profile of one motor can be varied with time independently of the others. The displacement mapping method uses encoders, such as optical encoders, to obtain the displacement of each of the associated motors as a function of time. From the actual displacement of the master motor, an electronic computation device or process is used to calculate the theoretical displacement of each slave motor according the motion profile of the slave motor. The theoretical displacement is then compared to the actual displacement. If there is a discrepancy between the theoretical and the actual amount then the motion of the slave motor will be adjusted so as to eliminate that displacement discrepancy.

In general, the method includes the steps of obtaining the displacement transformation function at each commanded position and mapping the actual displacement of the master motor onto the displacement of the slave motor using the transformation function. The result of the displacement mapping is the theoretical displacement of the slave motor. The theoretical displacement is then compared to the actual displacement of the slave motor. The synchronism between the master and slave motors can be achieved by adjusting the speed of the slave motor based on the comparison.

It should be noted that, the relationship between the motion profile of each slave motor and the motion profile of the master motor, in general, is not linear. For example, the slave motors in an inserting machine may start and stop within a feeding cycle while the master motor has a constant speed. Accordingly, the transformation function is nonlinear. Moreover, the speed of the master motor can be changed while the synchronism between the master motor and slave motors is maintained.

The present invention will become apparent upon reading the description taken in conjunction with FIG. 1 to FIG. 5B.

BRIEF DESCRIPTION OF THE DRAWINGS

FIGS. 5A and 5B illustrate the procedure for displacement mapping from the master motor to the slave motor.

DETAILED DESCRIPTION

Figure 1:
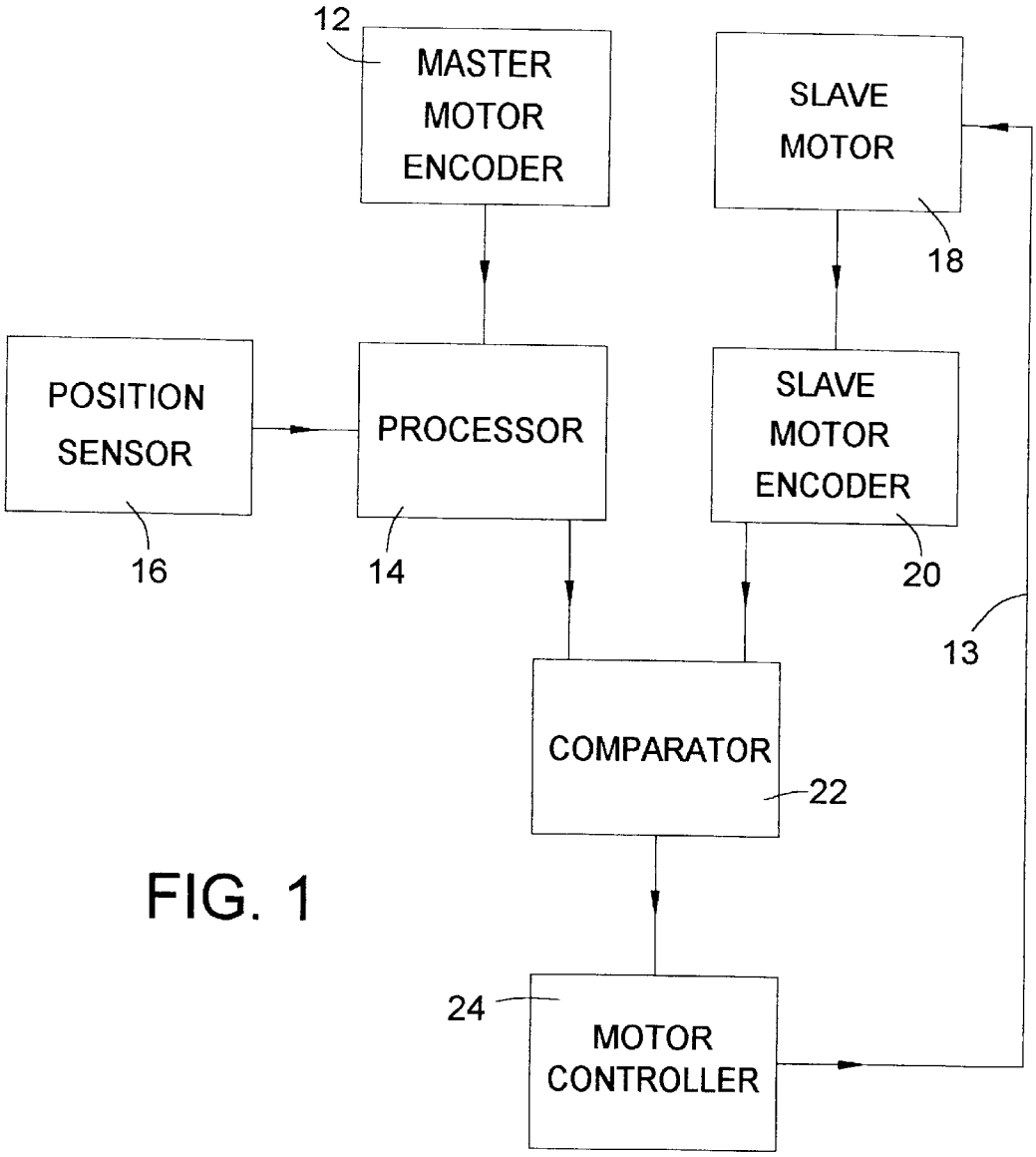
FIG. 1 shows a flow chart of motor control when the displacement mapping method is used to synchronize motion between a master motor and a slave motor.

FIG. 1 shows a block diagram of motor control when the displacement mapping method is used to synchronize the motion between a master motor and a slave motor. As shown, an electronic processor 14 is used to read the actual displacement of the master motor from an encoder 12, which is attached to the master motor. Based on the theoretical motion profile of a slave motor 18 at a commanded position and the displacement of the master motor, processor 14 calculates the theoretical displacement for slave motor 18. The actual displacement of the slave motor 18 is read from a slave motor encoder 20 and compared to the theoretical displacement at a comparator 22. Based on the discrepancy between the actual and the theoretical amounts, a motor controller 24 adjusts the speed of the slave motor 18 so as to eliminate the discrepancy in order to maintain the synchronism between the master motor and the slave motor 18. In FIG. 1, there is also shown one or more position sensors 16 that can be used to indicate a certain machine condition in order to change the commanded position.

Preferably, encoder 12 is an optical encoder, and the motor controller 24 includes a feedback loop 13. The master motor and the slave motor 18 can be stepping motors or servo motors.

Figure 2:
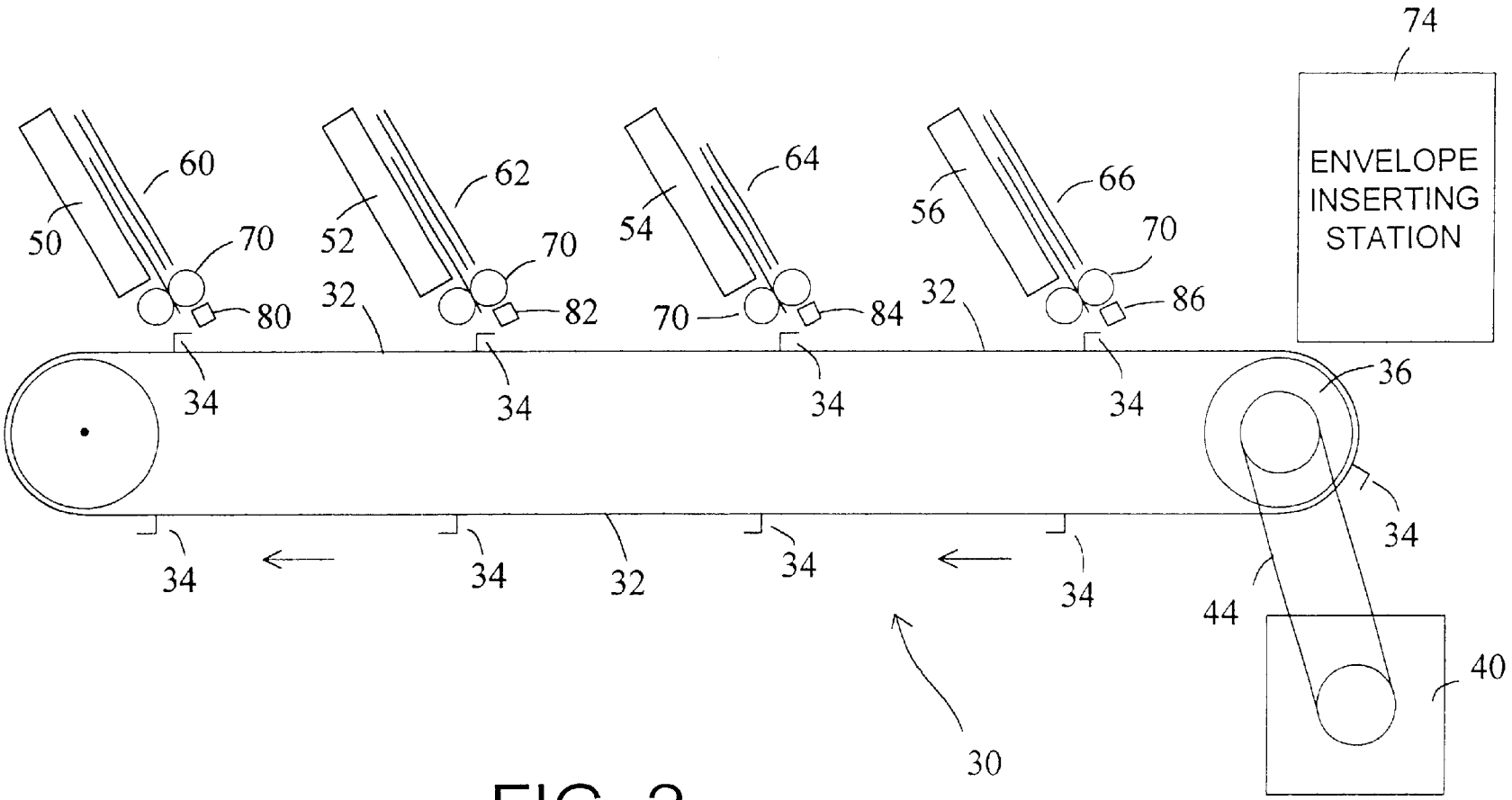
FIG. 2 illustrates a typical mail inserting machine having a chassis and a plurality of enclosure feeders.

FIG. 2 illustrates a typical insert feeding section 30 of an envelope inserting machine. As shown in FIG. 2, the insert feeding section, or the chassis subsystem 30, includes a conveyer belt 32, to transport documents. A plurality of pusher fingers 34, which are equally spaced and rigidly attached to the conveyor belt 32, are used to gather the released documents before the released documents are collated for insertion. A driven sprocket 36, driven by a chassis motor 40 and a belt 44, is typically used to move the belt 32. In normal operations, belt 32 moves substantially at a constant speed and the pusher fingers 34 move at the same speed along with the belt 32. Also shown in FIG. 2 are a plurality of enclosure feeders 50, 52, 54 and 56 mounted above belt 32 for feeding documents 60, 62, 64 and 66, respectively. Each enclosure feeder (50, 52, 54 and 56) has a releasing mechanism 70 which is driven by a feeder motor (not shown) and releases one sheet of document at a time upon receiving a releasing command. The timing of the release command for each feeder (50, 52, 54 and 56) is determined by the length of the document to be released and the arrival of a pusher finger at a feeder (50, 52, 54 and 56). In order to allow pusher fingers 34 to properly push the released documents toward an inserting station 74, it is preferred hat the trailing edge of a document released from an enclosure feeder (50, 52, 54 and 56) be just slightly forward of a moving pusher finger 74. It should be noted that, after an enclosure feeder has completely released a document to the chassis 30, it also partially releases the subsequent document, waiting for the arrival of the next pusher finger 34. The partially released document does not reach the chassis 30 while it is in waiting. Accordingly, a plurality of sensors 80, 82, 84 and 86 can be installed on the respective enclosure feeders 50, 52, 54 and 56 to sense the leading edge of the partially released document from each feeder (50, 52, 54 and 56), When a sensor (80, 82, 84 and 86) detects the leading edge of this subsequent document, it sends a signal to a motor controller 24, which is not shown, to start the deceleration of the respective feeder motor. In the insert feeder station 30, the chassis motor 40 is the master motor while each of the feeder motors (not shown) is a slave motor 18, as shown in FIG. 1.

Figure 3A:
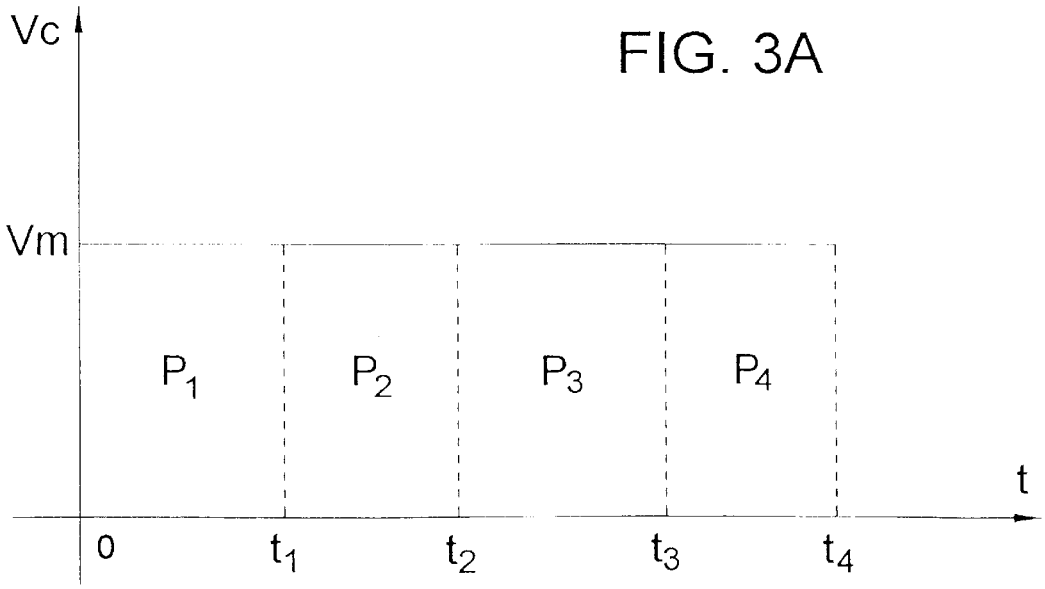
FIGS. 3A and 3B illustrate, respectively, a typical motion profile of a chassis motor and that of an enclosure feeder motor in normal operations.
Figure 3B:
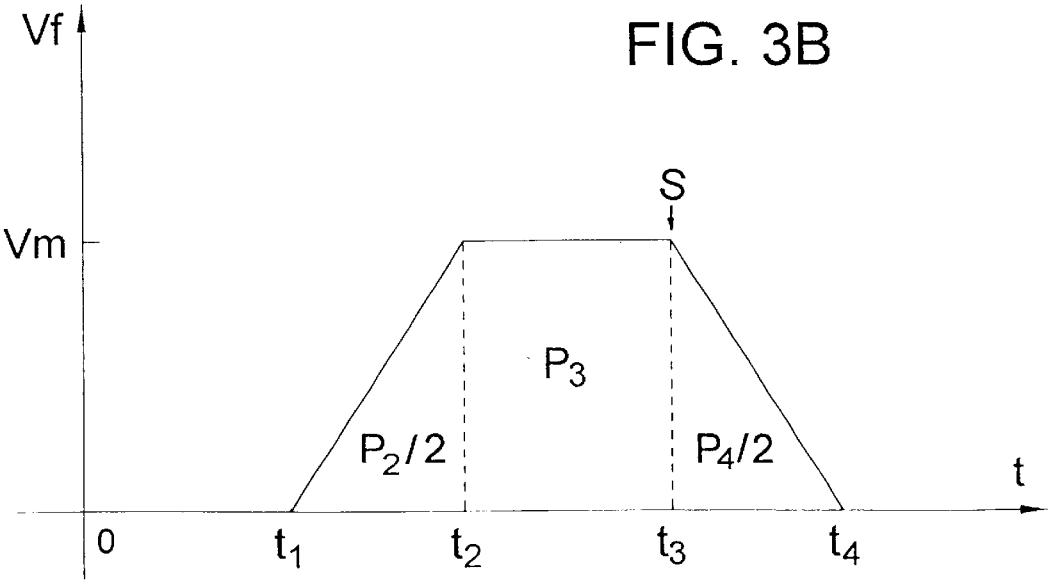

FIGS. 3A and 3B illustrate an example of motion synchronism between the chassis (master) and an enclosure feeder (slave) in a mail inserting machine. FIG. 3A shows that the speed, $V_c$, of the chassis motor 40, being kept constant at all times. In the figure, $P_1$ denotes the displacement of the chassis as read from the encoder 12 attached to the chassis (master) motor 40, from t=0 to $t=t_1$, or $P_1=V_m t_1$. From t=0 to $t=t_1$, the feeder (slave) motor 18 is idle and, therefore, the displacement of the feeder motor 18 is zero, as shown in FIG. 2B. At $t_1$, the feeder motor 18 is accelerated at a constant rate, k, such that the speed $V_f$, of the feeder motor 18 reaches $V_m$ at $t=t_2$. Therefore, the required acceleration rate is given by:

$$k=V_m/(t_2-t_1) \tag{1}$$

Since the speed $V_m$ of the chassis is known, the displacement of the chassis motor 40 can be calculated as follows:

$$P_2=V_m(t_2-t_1) \tag{2}$$

The displacement of the chassis motor 40 between $t_1$ and $t_2$ is given by:

$$\begin{aligned} P_c &= V_m(t-t_1) \\ &= P_2(t-t_1)/(t_2-t_1) \end{aligned} \tag{3}$$

When $P_c$ is equal to $P_2$, the feeder motor 18 starts to move at a constant speed, $V_m$.

When t3 $t_2$, a document that has reached the chassis will move along with the conveyor belt 32 at the same speed. Thus, as soon as the document is released from the enclosure feeder (50, 52, 54 and 56), the feeder motor 18 can be decelerated and stopped until the next feeding cycle. It is preferred that a sensor (80, 82, 84 and 86), such as an optical sensor, be used to make sure the release of document has been completed. The sensor (80, 82, 84 and 86) is placed downstream from the enclosure feeder (50, 52, 54 and 56) to detect the leading edge of the released document, as shown in FIG. 2. The sensing of the leading edge marks the time $t=t_3$, as denoted by the letters in the figures. At $t=t_3$, the deceleration of the feeder motor 13 begins. It should be noted that it is not necessary to know the actual value of $P_3$ since as long as the chassis motor 40 is maintained at a constant speed, $V_m$, the displacement of the chassis motor 40 from $t_2$ to $t_3$ is given by:

$$P_c=V_m(t-t_2) \tag{4}$$

and $P_3=V_m(t_3-t_2)$.

When $t=t_3$, it is preferred that the feeder motor 18 starts to decelerate at a constant rate, $k_-$, until it comes to a complete halt at $t=t_4$. If the chassis (i.e. belt 32) and the enclosure feeder (50, 52, 54 and 56) are in perfect synchronism, then the displacement $P_4$ can also be calculated from $V_m$ and $(t_4-t_3)$. The displacement of the chassis any time between $t_3$ and $t_4$ is given by:

$$P_c=P_4(t-t_3)/(t_4-t_3) \tag{5}$$

In the above-described example, $P_1$ is the first commanded position. It means that from t=0 the motion profile of the feeder motor 18 is $V_f=0$, that is, the enclosure feeder motor 18 is idle. But when the actual displacement, $P_c$, of the chassis reaches the first commanded position, it causes a change in the motion profile of the chassis.

Between $t_1$ and $t_2$, the speed profile of the feeder motor 18 is $$V_f=k(t-t_2)=V_m(t-t_1)/(t_2-t_1) \tag{6}$$

The theoretical displacement of the feeder motor 18, according to the motion profile of Equation (6), is given by:

$$\begin{aligned} P_f &= (2)k(t-t_1)^2 \\ &= (2)V_m(t-t_1)/(t_2-t_1) \\ &= (2)P_2(t-t_1)^2/(t_2-t_1)^2 \\ &= (2)P_c^2/P_2 \end{aligned} \tag{7}$$

Equation (7) represents the transformation function for displacement mapping from the chassis motor 40 to the feeder motor 18 in the time interval $t_1$ and $t_2$, and the transformation function is non-linear. $P_2$ is referred to as the second commanded position. This means that when $P_c$ reaches the second commanded position, the motion profile of the feeder motors 18 undergoes another change, as does the transformation function for displacement mapping. Between $t_2$ and $t_3$, the motion profile of the feeder motor 18 is $$V_f = V_m \tag{8}$$

Thus, the theoretical displacement of the feeder motor 18 according to the motion profile of Equation (8) is given by:

$$P_f = P_c \tag{9}$$

Between $t_3$ and $t_4$, the motion profile of the feeder motor 18 is given by $$V_f = V_m - k = (t - t_3) \tag{10}$$

Thus, the theoretical displacement of the feeder motor 18 according to the motion profile of Equation (10) is given by:

$$\begin{aligned} P_f &= (2)k = (t-t_3)^2 \\ &= (2)V_m(t-t_3)/(t_4-t_3) \\ &= (2)P_4(t-t_3)^2/((t_4-t_3)^2 \\ &= (2)P_c^2/P_4 \end{aligned} \tag{11}$$

Again, the transformation function for the displacement mapping from the chassis motor 40 to the feeder motor 18 is non-linear.

As shown above, the theoretical displacement of the feeder motor 18, at any time and any commanded position, can be calculated from the displacement of the chassis motor 40, regardless of the velocity of the chassis motor 40.

Figure 4A:
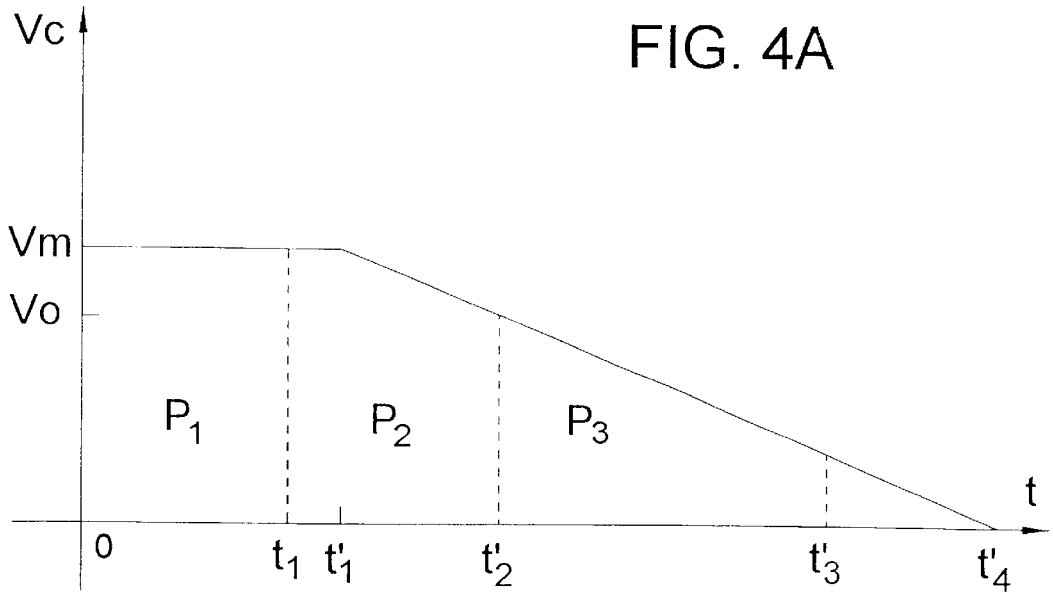
FIGS. 4A and 4B illustrate, respectively, the motion profile of the chassis motor in a controlled stop condition, and the distorted motion profile of the slave motor.
Figure 4B:
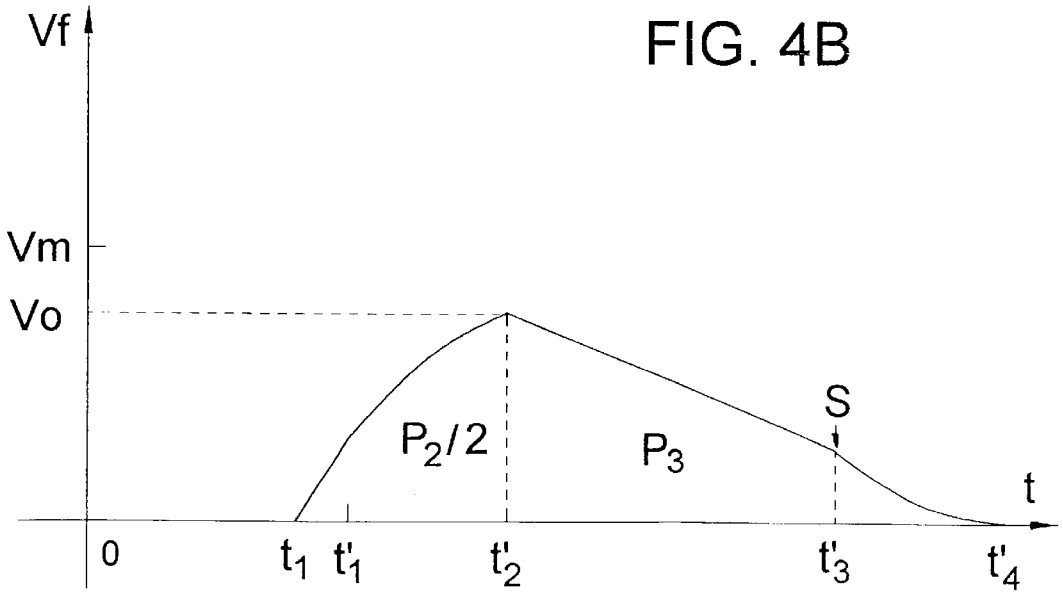

FIGS. 4A and 4B illustrate the relative speed between the chassis motor 40 and the enclosure feeder motor 18 within a feeding cycle wherein the chassis motor 40 is slowed down during a feeding cycle, in a controlled stop condition. As shown in FIG. 4B, the feeder motor 18 is accelerated at $t_1$ as in a normal feeding cycle depicted in FIG. 3B, and the chassis motor 40 is at a constant speed, $V_m$, until $t_{_}$, a shown in FIG. 4A. At $t=t_{_}$, the chassis motor 40 starts decelerating at a constant rate until it stops at $t_{4_}$. As the speed of the chassis motor 40 is decreasing after $t_{_}$, the motion profile of the feeder motor 18 starts to change accordingly. It should be noted that the actual displacement of the chassis motor 40 is mapped onto the displacement of the feeder motor 18, according to Equation (7), regardless of the speed of the chassis motor 40. Therefore, although the motion profile of the feeder motor 18 is distorted because of the change of the chassis speed, the displacement of the feeder motor 18 is equal to $P_2/2$ when the displacement of the chassis motor 40 reaches the second commanded position, or $P_2$, at $t_2'$. Thus, the synchronism between the chassis and the enclosure feeder is maintained. This fact is demonstrated in FIG. 5B.

From $t_{2_}$ to $t_3'$, according to Equation (8) and Equation (9), the motion profile and the displacement of the feeder motor 18 are the same as those of the chassis motor 40. Again, $t_3'$ is the time when the sensor (80, 82, 84 and 86) detects the leading edge of a released document, as indicated by the letter S, and the transformation function for displacement mapping is changed to Equation (11) thereafter. As expected, the feeder motor 18 stops at the same time as the chassis motor 40 at $t_{4_}$, if the displacement of the chassis motor 40 from $t_{3_}$ and $t_{4_}$ is less than $P_4$.

FIGS. 5A and 5B illustrate the procedure for displacement mapping between the master motor to the slave motor. FIG. 5A illustrates the displacement mapping in a normal feeding cycle after the chassis motor 40 reaches the first commanded position. As shown in FIG. 5A, the curve in the first quadrant represents Equation (3) which shows that the chassis motor 40 is running at a constant speed, $V_m$. The curve in the second quadrant represents the transformation function at the first commanded position, as given by Equation (7). The procedure of displacement mapping is exemplified by the following steps: 1) at a point c between $t_2$ and $t_1$, look up for a point d on the curve in the first quadrant; 2) find a point e on the $P_c$ axis, with point e being the actual displacement of the chassis motor 40; 3) look up for a point f on the curve in the second quadrant; and 4) obtain a point g on the $P_f$ axis, with point g being the theoretical displacement of the feeder motor 18.

It should be noted that the curve in the second quadrant represents a motion profile of the feeder motor 18 relative to the chassis motor 40, and it is unchanged regardless of what happens to the chassis motor 40. Therefore, a fixed algorithm can be used to calculate the theoretical displacement of the feeder motor 18 from the actual displacement of the chassis motor 40. Alternatively, a look-up-table can be used to obtain the theoretical displacement of the feeder motor 18. However, the slope of the curve in the first quadrant represents the actual speed of the chassis motor 40 and the speed can vary at times or be changed by the machine operator. Therefore, the displacement of the chassis motor 40 cannot be accurately predicted by using a look-up-table or equivalent.

FIG. 5B illustrates the validity of the displacement mapping method for maintaining the synchronism between the master motor and the slave motor, regardless of the speed changes of the master motor within a feeding cycle. As shown in FIG. 5B, the speed of the chassis motor 40 changes and becomes non-constant at $t=t_{_}$. Accordingly, the curve in the first quadrant is different from the corresponding curve in FIG. 5A. As shown, the slope of the curve is decreasing after $t_{_}$. However, the curve in the second quadrant is kept unchanged in order to maintain the synchronism between the chassis motor 40 and the feeder motor 18. The procedure of displacement mapping remains the same as: 1) at a point $c_{_}$ between $t_2$ and $t_1$, look up for a point $d_{_}$ on the curve in the first quadrant; 2) find a point $e_{_}$ on the $P_c$ axis, with point $e_{_}$ being the actual displacement of the chassis motor 40; 3) look up for a point $f_{_}$ on the curve in the second quadrant; and 4) obtain a point $g_{_}$ on the $P_f$ axis, with point $g_{_}$ being the theoretical displacement of the feeder motor 18. It should be noted that even though $c_{_}=c$, the actual displacement of the chassis is less than f due to the slowdown of the chassis motor 40. Accordingly, the theoretical feeder displacement is less than g. However, when $P_c$ reaches $P_2$ at $t=t_{2_}$, $P_f=P_2/2$. Thus, the synchronism between the chassis motor 40 and the feeder motor 18 is maintained even though the motion profile of the chassis motor 40 varies with time.

Although the invention has been described with respect to a preferred version thereof, it will be understood by those skilled in the art that the foregoing and various other changes, omissions and deviations in the form and detail thereof may be made without departing from the spirit and scope of this invention.

What is claimed is:

1. In an envelope inserting machine wherein a plurality of enclosure feeders are used to feed documents to a chassis, wherein each enclosure feeder has a releasing device to release enclosure documents, one at a time, and the chassis has a chassis driving device to drive a chassis transport in order to gather the released documents before the released documents are collated for insertion, a method of synchronizing motion in an operational cycle between the chassis driving device and each of the releasing devices by using a plurality of encoding devices to obtain actual displacement amounts of the chassis driving device and each releasing device as a function of time, wherein said operational cycle has a number of commanded positions for defining motion profiles of each releasing device relative to the chassis driving device, said method comprising the steps of:

1) obtaining an actual displacement of the chassis driving device;

2) obtaining a theoretical displacement of each releasing device based on the corresponding motion profile of the respective releasing device and the actual displacement of the chassis driving device in order to control the movement of the respective releasing device;

3) obtaining an actual displacement of each releasing device, 4) obtaining the discrepancy between the actual displacement and the theoretical displacement for each releasing device; and 5) adjusting the movement of each releasing device so as to substantially eliminate the displacement discrepancy in order to synchronize the motion of the chassis driving device and each releasing device.

2. The method of claim 1 wherein each enclosure document has an edge moving along with chassis transport and said mail inserter system comprises at least one sensing device for sensing the edge of the released enclosure document in order to change at least one commanded position.

3. The method of claim 1 wherein the chassis driving device is running at a constant speed within an operational cycle.

4. The method of claim 1 wherein the chassis driving device is running at a number of speeds within an operation cycle.

5. The method of claim 1 wherein at least one motion profile is non-linear.

6. The method of claim 1 further comprising the steps of:

6) obtaining a transformation function for displacement mapping from the chassis driving device to each releasing device at each of said at least one commanded position;

7) obtaining a value of the transformation function corresponding to the actual displacement of the chassis driving device; and 8) displacement mapping the actual displacement to each of the releasing devices according to the obtained value of the transformation function in order to obtain the theoretical displacement of each releasing device.

7. The method of claim 6 further comprising the steps of:

9) obtaining the actual displacement of each releasing device;

10) comparing the actual displacement of each releasing device to the theoretical displacement of the respective releasing device to obtain the discrepancy therebetween; and 11) adjusting the motion of each releasing device in order to substantially eliminate the respective discrepancy.

8. In an envelope inserting machine wherein a plurality of enclosure feeders are used to feed documents to a chassis, wherein each enclosure feeder has a releasing device to release enclosure documents, one at a time, and the chassis has a chassis driving device to drive a chassis transport in order to gather the released documents before the documents are collated for insertion, a method of synchronizing motion in an operational cycle between the chassis driving device and each of the releasing devices by using a plurality of encoding devices to obtain actual displacement amounts of the chassis driving device and each releasing device as a function of time, wherein said operational cycle has a number of commanded positions for defining motion profiles of each releasing device relative to the chassis driving device, said method comprising the steps of:

1) obtaining the transformation function for displacement mapping from the chassis driving device to each releasing device at each commanded position;

2) obtaining a first displacement of the chassis driving device;

3) obtaining a value of the transformation function corresponding to the first displacement;

4) displacement mapping the fist displacement to the respective releasing device according to the value of the transformation function obtained in step 3 in order to obtain a second displacement for the respective releasing device;

5) obtaining an actual displacement of the respective releasing device;

6) comparing the actual displacement to the second displacement to obtain the discrepancy therebetween; and 7) adjusting the motion of the respective releasing device so as to eliminate that discrepancy.

9. The method of claim 8, wherein the chassis driving device comprises a motor.

10. The method of claim 8, wherein each releasing mechanism comprises a motor.

11. An apparatus for synchronizing motion in an operational cycle between a chassis driving device and at least one releasing device in an envelope inserting machine by using encoding devices to obtain actual displacement amounts of each movement mechanism as a function of time, wherein said operational cycle has a number of commanded positions for defining motion profiles of each releasing device relative to the chassis driving device, said device comprising:

a first encoding device for obtaining the actual displacement of the chassis driving device;

a processing device for calculating the theoretical displacement of the each releasing device based on the corresponding profile thereof and the actual displacement of the chassis driving device in order to control the movement of the respective releasing device;

a plurality of second encoding devices, each for obtaining the actual displacement of one releasing device;

a comparison device for obtaining the discrepancy between the actual displacement and the theoretical displacement for each releasing device; and a controlling device to adjust the movement of each releasing device so as to substantially eliminate the discrepancy in order to synchronize the motion of the chassis driving device and each releasing device.

12. The apparatus of claim 11 wherein said chassis driving device comprises a motor.

13. The apparatus of claim 11 wherein said releasing device comprises a motor.

14. The apparatus of claim 11 wherein said first encoding device comprises an optical encoder.

15. The apparatus of claim 11 wherein each second encoding device comprises an optical encoder.

16. The apparatus of claim 11 wherein said processing device comprises an electronic processor.

* * * * *